United States Patent [19]

Hilton et al.

[11] Patent Number: 4,583,517

[45] Date of Patent: Apr. 22, 1986

[54] FIREPLACE SCREEN

[75] Inventors: James Hilton, 3945 Rigel Ave., Lampoc, Calif. 93436; Joel S. Crosby, Santa Barbara, Calif.

[73] Assignee: James Hilton, Lampoc, Calif.

[21] Appl. No.: 536,261

[22] Filed: Sep. 27, 1983

[51] Int. Cl.[4] ..... F23L 5/02; E05F 15/20

[52] U.S. Cl. ..... 126/135; 126/202; 126/138; 160/1; 160/98; 160/241; 160/310; 160/312; 160/DIG. 9; 49/30; 49/378; 49/380

[58] Field of Search ..... 126/135, 140, 136, 202, 126/138; 160/DIG. 9, 7, 1, 2, 98, 241, 270, 310, 312; 49/378, 380, 30

[56] References Cited

U.S. PATENT DOCUMENTS

| | | | |
|---|---|---|---|
| 813,505 | 2/1906 | Lowry | 126/135 |
| 1,659,526 | 2/1928 | Harader . | |
| 1,676,893 | 7/1928 | Eisele | 126/135 |
| 1,726,854 | 9/1929 | Mumford | 126/202 |
| 2,015,485 | 9/1935 | Lindberg . | |
| 2,483,608 | 10/1949 | Arany . | |
| 2,492,721 | 12/1949 | Vita . | |
| 2,606,607 | 8/1952 | Vita . | |
| 2,803,241 | 8/1957 | Chapla . | |
| 3,021,130 | 2/1962 | Allerdice et al. | 49/30 X |
| 3,082,759 | 3/1963 | David et al. | 126/135 |
| 3,583,465 | 6/1971 | Youngs et al. | 160/310 X |
| 3,848,653 | 11/1974 | Youngs . | |
| 4,035,702 | 7/1977 | Pettersen et al. . | |
| 4,086,906 | 5/1978 | Reichgut . | |
| 4,365,442 | 12/1982 | Speer | 49/30 X |
| 4,366,595 | 1/1983 | Elliott | 49/30 X |

*Primary Examiner*—Randall L. Green

*Attorney, Agent, or Firm*—Schwartz, Jeffery, Schwaab, Mack, Blumenthal & Evans

[57] ABSTRACT

The fireplace screen comprises a frame defining a central opening and including first and second pairs of vertical guide tracks along opposite lateral sides of the opening. A housing is mounted above the frame and a first flexible covering element is mounted for movement in the first pair of guide tracks. The first flexible covering element comprises a perforate mesh formed of heat resistant material. A second flexible covering element is mounted for movement in the second pair of guide tracks. The second covering element comprises an imperforate heat resistant material. A mechanism is mounted in the housing for individually raising and lowering the first and second covering elements in the guide tracks thereby covering and uncovering the central opening.

12 Claims, 3 Drawing Figures

FIREPLACE SCREEN

BACKGROUND OF THE INVENTION

1. Field of the Invention

This invention relates to fireplace screens and more particularly to fireplace screens which are specifically adapted to prevent burning embers from escaping from a fireplace firebox when the fireplace is temporarily unattended.

2. Discussion of Related Art

Various forms of fireplace screens are known in the art. These screens have a common goal of preventing burning embers from escaping from a fireplace and igniting combustible materials in a room in which the fireplace is situated. Fireplace screens are also known which incorporate glass doors in addition to a movable mesh material. The doors can be closed in order to reduce the amount of warm air lost to the fireplace. However, none of the known screens provides a relatively simple construction which is easy to use and ensures that a fireplace left open will be closed when it is inadvertently unattended.

Examples of conventional fireplace screens incorporating flexible webbing which can be attached to rollers positioned over a fireplace opening can be found in U.S. Pat. Nos. 1,659,526 to Harader, 2,015,485 to Lindberg, 2,483,608 to Arany, 2,803,241 to Chapla, and 4,086,906 to Reichgut. The patent to Harader also discloses the use of a heavy rod attached to the lower end of the fireplace screen in order to aid the screen in descending by gravity. Chapla discloses an edging member which is attached to the lower edge of the screen for stabilization, and Reichgut discloses a rod which is secured to the lower end of an asbestos screen, as well as chains which are used to connect different sections of the screen to a lifting mechanism.

U.S. Pat. Nos. 2,492,721 and 2,606,607 to Vita, and 3,848,653 to Youngs disclose flexible screens which are motor operated to cover or uncover an aperture.

U.S. Pat. No. 4,035,702 to Pettersen et al shows a garage door opener of the flexible curtain type which includes a mechanism for closing the garage door after a given period of time in the event that a user forgets to close the door.

SUMMARY OF THE INVENTION

One object of the present invention is to provide a fireplace screen which is easy to use and provides protection both from the escape of burning embers from the fireplace and from the loss of warm air from a room into the fireplace.

Another object of the present invention is to provide a fireplace screen having closure members which can be easily rolled up and stored in a convenient location over the fireplace opening.

An additional object of the present invention is to provide a fireplace screen which will automatically close off a fireplace opening which has been inadvertently left uncovered.

Yet another object of the present invention is to provide a fireplace screen which is relatively simple in construction yet durable and effective in use.

In accordance with the above and other objects, the present invention is a fireplace screen comprising a frame defining a central opening and including first and second pairs of vertical guide tracks along opposite lateral sides of the central opening. A housing is mounted above the frame and first and second flexible covering elements are mounted for movement in the guide tracks. The first covering element comprises a perforate mesh formed of heat resistant material and the second covering element is an imperforate heat resistant material. Means are mounted in the housing for raising and lowering the covering elements in the guide tracks so that either covering element can be disposed over the central opening individually.

In accordance with other asepcts of the invention, the means for moving the first covering element may comprise an electric motor and a time delay means for automatically lowering the first covering element a predetermined time after it has been raised.

The first covering element may also comprise a weight attached to the bottom of the mesh material for causing the mesh material to hang vertically in the guide tracks. A cable may also be interwoven in the mesh material to prevent the mesh from stretching.

The imperforate material may be transparent and may also have a weight attached to its bottom portion.

The means for moving the first and second covering elements may comprise rollers mounted in the housing as well as means for coiling the covering elements onto the rollers. The coiling may be effected manually or an electric motor may be used.

DETAILED DESCRIPTION OF THE PREFERRED EMBODIMENT

Figure 3:
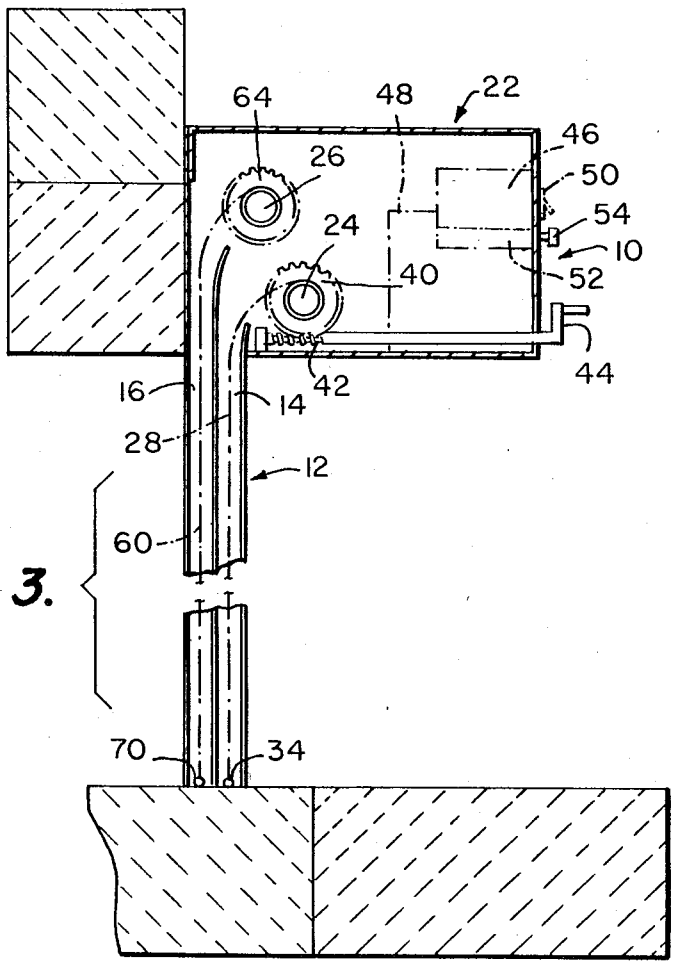
FIG. 3 is a vertical sectional view of the fireplace screen according to the present invention.
Figure 1:
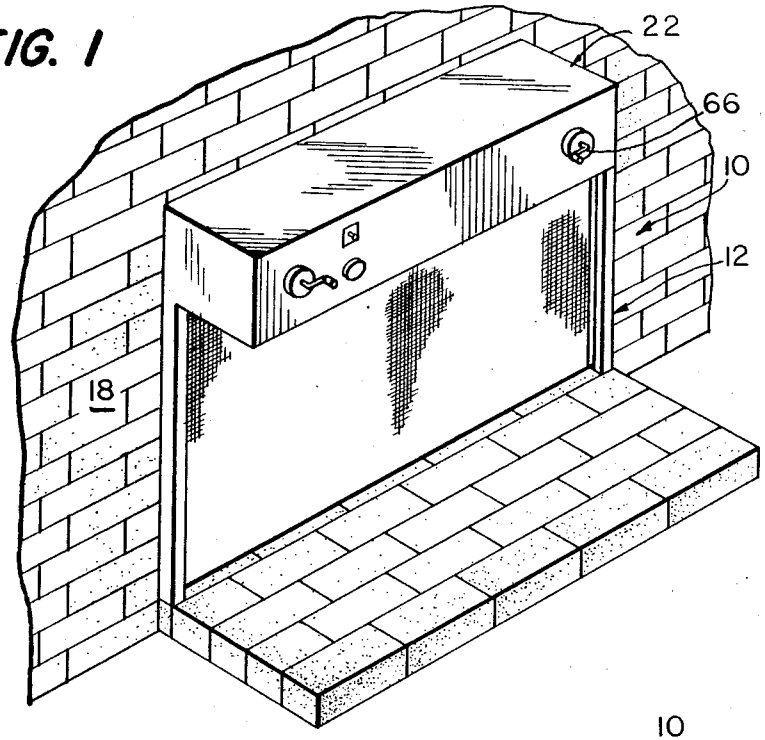
FIG. 1 is a perspective view of a fireplace using a fireplace screen according to the present invention.
Figure 2:
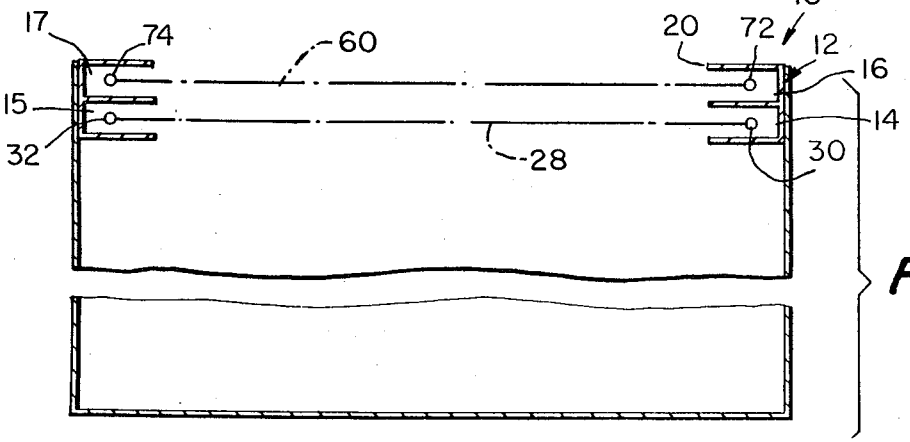
FIG. 2 is a top plan sectional view of the fireplace screen according to the present invention.

As seen in FIGS. 1–3, the fireplace screen 10 includes a frame 12 having a first pair of guide tracks 14 and 15, and a second pair of guide tracks 16 and 17. The frame and guide tracks are disposed vertically along the fireplace facade 18 and define an opening 20 which is coextensive with the fireplace opening. The frame 12 may be sealed against the facade 18 to prevent air from entering the fireplace.

A housing 22 is mounted over frame 12. Housing 22 contains rollers 24 and 26. Roller 24 receives a first covering element comprising a mesh material 28 having cables 30 and 32 intertwined along its sides to keep the mesh material from stretching. A weight such as an elongated metal bar 34 is attached to the bottom of the mesh material 28 and to the bottom of cables 30 and 32 in order to ensure that the mesh material hangs straight. The sides of mesh material 28 which are connected to cables 30 and 32 are disposed in guide tracks 14 and 15, respectively. Accordingly, by rotating roller 24, mesh material 28 is coiled thereon or uncoiled therefrom. In this manner, the mesh material screen can be raised or lowered to cover or uncover opening 20.

In order to rotate roller 24, a gear 40 can be provided on one end of the roller. Gear 40 meshes with worm gear 42 which is rotated by handle 44. Accordingly, if the user wishes to manually raise mesh 28, handle 44 is rotated until the mesh is raised a desired amount.

It sometimes occurs, however, that a user may inadvertently leave a fireplace screen open when the fire is not attended. This can cause a fire hazard when embers from the fire enter a room. Accordingly, according to the present invention, a reversible motor 46 may be mounted in housing 42 and connected to drive worm gear 42 through a mechanical connection shown schematically at 48. A raise and lower switch 50 is provided on motor 46. In one position, switch 50 causes the screen 28 to be raised and in a second position, switch 50 causes mesh 28 to be lowered. In addition, a time delay 52 may be provided to control motor 46. Time delay 52 is activated when mesh 28 is raised from its lowermost position such that, after a predetermined time set by adjustment knob 54, the screen 28 is automatically lowered. The details of motor 46, time delay 52 and mechanical connection 48 are not shown as these details would be obvious to one of ordinary skill in the art.

As can be understood from the foregoing, if one opens mesh 28 to, for example, add additional wood to the fire, and then leaves prior to returning mesh 48 to its original lowered position, time delay control 52 will automatically perform this function after the delay set by adjustment 54. Accordingly, after, for example, two minutes, the mesh 28 will once again be lowered to close off opening 20 thereby eliminating any potential fire hazard.

A second covering element 60 is disposed in guide tracks 16 and 17. Covering element 60 is an imperforate heat shield which is preferably disposed between mesh 28 and the fire itself. Element 60 is preferably a flexible sheet of elongated heat resistant material but could be formed of hinged sections of solid material also. Element 60 is connected to roller 26 and can be coiled thereon to cover or uncover opening 20. Roller 26 is attached to a gear 64 which is operated by handle 66 through a worm gear (not shown) similar to worm gear 42. A weight 70 can be attached to the lower end of element 60 and cables 72 and 74 can be attached to its sides so as to ensure that the element 60 will not stretch and will hang straight.

Heat shield 60 is preferably transparent but could also be of an opaque material. The main purpose of this heat shield is to close off the fireplace opening when no one is present in the room to appreciate the fire. With the opening completely closed, the fire would not draw already heated air from the room. As is well known, fireplaces normally detract from the heating efficiency of a home by drawing such air out of the home. Accordingly, when the heat shield 60 is in place, the room containing the fireplace could be heated more efficiently.

In operation, heat shield 60 could also be used as an air flow control by disposing the bottom of the heat shield a predetermined distance from the top of the fireplace hearth thereby limiting the amount of air entering the firebox. Alternatively, flow control valves could be disposed in housing 22 so as to control the combustion level.

It is also possible to operate roller 26 with a motor (not shown) similar to reversible motor 46 having a time control attached. In this case, one could set the timer to close the heat shield 60 at, for example, midnight, on the assumption that everyone had gone to bed by then and, if the heat shield were still open, it would be by inadvertence.

The foregoing description is provided for the purpose of illustrating the present invention but is not deemed to be limitative thereof. Clearly, numerous additions and other modifications can be made to the invention without departing from the scope thereof, as set forth in the appended claims.

What is claimed is:

1. A fireplace screen comprising:

a frame defining a central opening and including first and second pairs of vertical guide tracks along opposite lateral sides of said central opening;

a housing mounted above said frame;

a first flexible covering element mounted for movement in said first pair of guide tracks, said first flexible covering element comprising a perforate mesh formed of heat resistant material;

a second covering element mounted for movement in said second pair of guide tracks, said second covering element comprising an imperforate heat resistant material; and moving means mounted in said housing for individually raising and lowering said first and second covering elements in said guide tracks thereby covering and uncovering said central opening, said moving means comprising an electric motor operatively connected to said first covering element, and time delay means for automatically lowering said first covering element a predetermined time after said first covering element has been raised.

2. A fireplace screen as set forth in claim 1, wherein said first covering element further comprises a weight attached to the bottom of said mesh material for causing said mesh material to hang vertically in said first pair of guide tracks.

3. A fireplace screen as set forth in claim 1, wherein said first covering element further comprises a cable interwoven in said mesh material to prevent said mesh material from stretching.

4. A fireplace screen as set forth in claim 1, wherein said imperforate heat resistant material is transparent.

5. A fireplace screen as set forth in claim 1, wherein said moving means further comprises a roller connected to one end of said first covering element, and manual means for coiling said first covering element onto said roller.

6. A fireplace screen as set forth in claim 5, wherein said coiling means comprises a manually rotatable handle.

7. A fireplace screen as set forth in claim 5, wherein said coiling means comprises a reversible motor.

8. A fireplace screen as set forth in claim 1, wherein said moving means further comprises a roller connected to one end of the said second covering element, and manual means for coiling said second covering element onto said roller.

9. A fireplace screen as set forth in claim 8, wherein said coiling means comprises a manually rotatable handle.

10. A fireplace screen comprising:

a frame defining a central opening and including a first pair of vertical guide tracks along opposite lateral sides of said central opening;

a housing mounted above said frame;

a first flexible covering element mounted for movement in said first guide tracks, said first flexible covering element comprising a perforate mesh material;

means mounted in said housing for raising and lowering said first covering element, said means including a reversible motor and time delay means connected to said motor to lower said first covering element a predetermined time after said first covering element has been raised.

11. A fireplace screen as set forth in claim 10, includng means for adjusting said predetermined time.

12. A fireplace screen as set forth in claim 10, including a second pair of vertical guide tracks along opposite sides of said central opening; a second flexible covering element mounted for movement in said second pair of guide tracks, said second covering element comprising an imperforate heat resistant material.

* * * * *